US009037043B2

(12) United States Patent
Warita et al.

(10) Patent No.: US 9,037,043 B2
(45) Date of Patent: May 19, 2015

(54) IMAGE FORMING APPARATUS, PROCESS CARTRIDGE, AND IMAGE FORMING METHOD

(75) Inventors: Yasuhiro Warita, Kanagawa (JP); Masaya Okamoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 12 days.

(21) Appl. No.: 13/561,929

(22) Filed: Jul. 30, 2012

(65) Prior Publication Data

US 2013/0251400 A1 Sep. 26, 2013

(30) Foreign Application Priority Data

Mar. 22, 2012 (JP) ..... 2012-064811

(51) Int. Cl.
*G03G 15/00* (2006.01)
*G03G 21/18* (2006.01)

(52) U.S. Cl.
CPC ..... *G03G 15/757* (2013.01); *G03G 21/186* (2013.01)

(58) Field of Classification Search
CPC ..... G03G 15/757; G03G 21/1857
USPC ..... 399/111, 167
See application file for complete search history.

(56) References Cited

U.S. PATENT DOCUMENTS

| | | | | |
|---|---|---|---|---|
| 5,126,800 | A * | 6/1992 | Shishido et al. | 399/111 |
| 2002/0085858 | A1 * | 7/2002 | Yamaguchi et al. | 399/167 |
| 2004/0190937 | A1 * | 9/2004 | Mercer et al. | 399/117 |

FOREIGN PATENT DOCUMENTS

| | | | |
|---|---|---|---|
| JP | 09179432 | A * | 7/1997 |
| JP | 10-232526 | A | 9/1998 |

* cited by examiner

*Primary Examiner* — Erika J Villaluna
(74) *Attorney, Agent, or Firm* — Sughrue Mion, PLLC

(57) ABSTRACT

An image forming apparatus includes a drive source that generates a driving force, an image forming object on which an electrostatic latent image is to be formed and that includes a rotatable shaft extending therethrough and rotates with the driving force that is input to one end of the rotatable shaft, and an extracting member that is provided at another end of the rotatable shaft of the image forming object and extracts, from the rotatable shaft, a driving force to be transmitted to a driven member excluding the image forming object.

22 Claims, 6 Drawing Sheets

IMAGE FORMING APPARATUS, PROCESS CARTRIDGE, AND IMAGE FORMING METHOD

CROSS-REFERENCE TO RELATED APPLICATIONS

This application is based on and claims priority under 35 USC 119 from Japanese Patent Application No. 2012-064811 filed Mar. 22, 2012.

BACKGROUND

Technical Field

The present invention relates to an image forming apparatus, a process cartridge, and an image forming method.

SUMMARY

According to an aspect of the invention, there is provided an image forming apparatus including a drive source that generates a driving force, an image forming object on which an electrostatic latent image is to be formed and that includes a rotatable shaft extending therethrough and rotates with the driving force that is input to one end of the rotatable shaft, and an extracting member that is provided at another end of the rotatable shaft of the image forming object and extracts, from the rotatable shaft, a driving force to be transmitted to a driven member excluding the image forming object.

BRIEF DESCRIPTION OF THE DRAWINGS

An exemplary embodiment of the present invention will be described in detail based on the following figures, wherein.

DETAILED DESCRIPTION

An exemplary embodiment of the present invention will now be described in detail with reference to the accompanying drawings.

Figure 1:
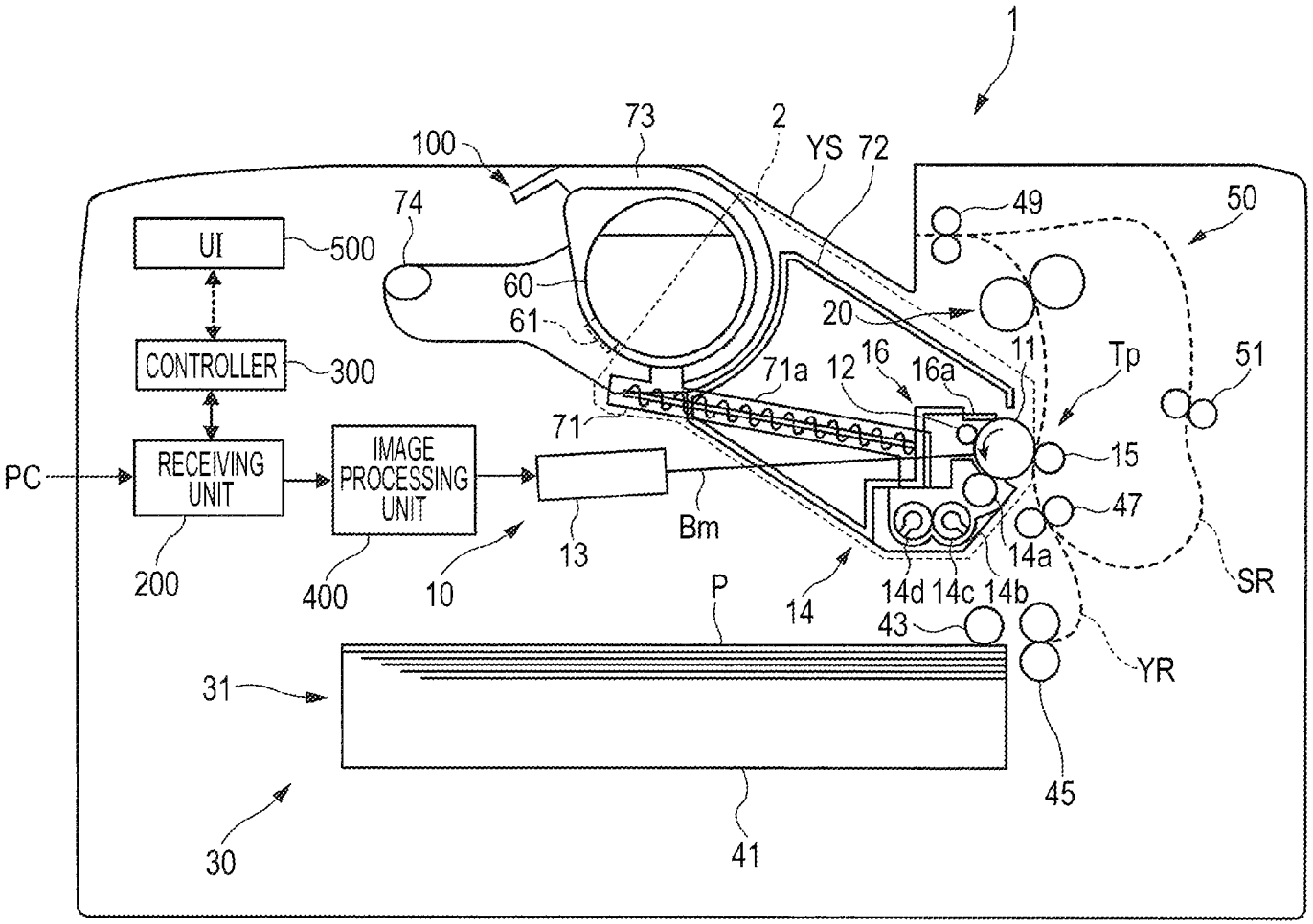
FIG. 1 schematically illustrates an image forming apparatus according to the exemplary embodiment.

FIG. 1 schematically illustrates an image forming apparatus 1 according to the exemplary embodiment. The image forming apparatus 1 includes an image forming section 10 that forms a toner image on a sheet P as an exemplary recording material, a fixing device 20 that fixes, through application of heat and pressure to the toner image, the toner image having formed on the sheet P by the image forming section 10, and a sheet feeding section 30 that feeds the sheet P to the image forming section 10.

The image forming apparatus 1 further includes a process cartridge 100. The process cartridge 100 is drawable toward the front side (the left side in FIG. 1) of the image forming apparatus 1, that is, the process cartridge 100 is detachable from the body of the image forming apparatus 1 (hereinafter also referred to as apparatus body). In the exemplary embodiment, after the process cartridge 100 is detached from the image forming apparatus 1, another process cartridge 100 is attachable to the image forming apparatus 1.

The process cartridge 100 includes a photoconductor drum 11, a charging device 12, a development device 14, and a cleaning device 16. The image forming apparatus 1 according to the exemplary embodiment further includes an exposure device 13 and a transfer device 15.

The image forming apparatus 1 further includes a toner cartridge 60 that is detachably attached to the body of the image forming apparatus 1. The toner cartridge 60 contains toner to be supplied to the process cartridge 100.

The toner cartridge 60 is provided with a storage medium 61 such as an electrically erasable and programmable read-only memory (EEPROM). The storage medium 61 stores information indicating the type of the toner cartridge 60 and information on the usage of the toner cartridge 60, such as the number of revolutions of a rotary member (a rotary member for transporting the toner) provided inside the toner cartridge 60.

The photoconductor drum 11 includes a photosensitive layer provided on the outer circumferential surface thereof and rotates in a direction of the arrow illustrated in FIG. 1. The charging device 12 includes a charging roller provided in contact with the photoconductor drum 11 and charges the photoconductor drum 11 with a predetermined potential.

The exposure device 13 selectively performs exposure by applying a laser beam Bm to the photoconductor drum 11 having been charged by the charging device 12, whereby an electrostatic latent image is formed on the photoconductor drum 11. The development device 14 includes a development roller and forms a toner image on the photoconductor drum 11.

More specifically, the development device 14 contains a two-component developer composed of, for example, a negatively chargeable toner and a positively chargeable carrier. The development device 14 develops the electrostatic latent image on the photoconductor drum 11 with the toner, thereby forming a toner image on the photoconductor drum 11.

The development device 14 will be described in more detail. The development device 14 includes a development roller 14*a*, a development housing 14*b* (also illustrated in FIG. 2) that holds the development roller 14*a*, an auger 14*c* provided in the development housing 14*b* and on a side of the development housing 14*b* nearer to the development roller 14*a*, and an auger 14*d* provided in the development housing 14*b* and on a side of the development housing 14*b* farther from the development roller 14*a*.

The development roller 14*a* includes a rotatable development sleeve made of nonmagnetic metal, and a magnetic roller fixedly provided inside the development sleeve and including plural magnetic poles. In addition, a metal trimmer (not illustrated) is provided on the development housing 14*b* so that a layer of the developer to be formed on the development roller 14*a* has a desired thickness.

The development housing 14*b* has a supply port (not illustrated) via which fresh developer is supplied into the development housing 14*b* and a discharge port (not illustrated) via which excessive developer is discharged from the development housing 14*b*. Furthermore, the development housing 14*b* has a partition wall (not illustrated) that separates the auger 14*c* and the auger 14*d* from each other while allowing the auger 14*c* and the auger 14*d* to be connected to each other at two ends thereof. The augers 14*c* and 14*d* each include a rotatable shaft extending in the depth direction in FIG. 1 and a spiral blade provided around the shaft.

The auger 14*c* rotates in such a manner as to stir and transport the developer in the development housing 14*b* in one direction, whereas the auger 14*d* rotates in such a manner as to stir and transport the developer in the development housing 14*b* in the opposite direction. The developer thus stirred and transported in the development housing 14*b* by the auger 14*c* and the auger 14*d* is made to circulate in the development housing 14*b*. The toner, which has a negative polarity, and the carrier, which has a positive polarity and magnetism, are stirred and transported together, causing friction therebetween, whereby the toner is negatively charged.

The transfer device 15 includes a roller member. An electric field is produced between the transfer device 15 and the photoconductor drum 11 (at a transfer part Tp). The transfer device 15 transfers the toner image on the photoconductor drum 11 to a sheet P by utilizing the electric field.

The cleaning device 16 includes a cleaning blade 16*a* provided in contact with the photoconductor drum 11. Toner residues and the like remaining on the photoconductor drum 11 after the transfer are removed by the cleaning blade 16*a*.

The image forming apparatus 1 includes a toner supplying unit 71 that supplies toner from the toner cartridge 60 to the process cartridge 100. The toner supplying unit 71 includes a supply pipe 71*a* via which fresh developer is supplied from the toner cartridge 60 to the development device 14, and a supply auger rotatably provided in the supply pipe 71*a*. When the supply auger rotates, the toner is transported from the toner cartridge 60 toward the development device 14.

The image forming apparatus 1 further includes a toner collecting unit 72 that collects waste toner, i.e., toner residues and the like removed by the cleaning blade 16*a* of the cleaning device 16.

The toner supplying unit 71 and the toner collecting unit 72 are included in the process cartridge 100.

As illustrated in FIG. 1, the sheet feeding section 30 includes a sheet feeding unit 31 that feeds a sheet P to the image forming section 10. The sheet feeding unit 31 includes a sheet container 41, a pickup roller 43, and a separating mechanism 45. The sheet container 41 has a rectangular-parallelpiped shape with the top thereof being open and contains a stack of plural sheets P. The pickup roller 43 is in contact with a topmost sheet P included in the stack of sheets P contained in the sheet container 41 and feeds some of the sheets P at the top of the stack toward the separating mechanism 45. The separating mechanism 45 includes, for example, a feed roller that is rotatable and a retard roller that is prevented from rotating. The separating mechanism 45 separates the topmost one of the sheets P having been fed by the pickup roller 43 from the others.

Any additional sheet feeding units may also be provided below the sheet feeding unit 31 so that sheets P of different sizes or different types are feedable to the image forming section 10.

The sheet feeding section 30 further includes a pair of registration rollers 47. The pair of registration rollers 47 temporarily stop the transport of the sheet P when not rotating. Then, the pair of registration rollers 47 rotate with a predetermined timing, thereby registering the sheet P and transporting the sheet P to the transfer part Tp.

In a case where any additional sheet feeding units (not illustrated) are provided, transport rollers (not illustrated) are also provided that transport the sheet P having been fed from any of the additional sheet feeding units (not illustrated) toward the pair of registration rollers 47.

The image forming apparatus 1 according to the exemplary embodiment includes a sheet transport path YR along which the sheet P is transported, and a sheet stacking portion YS on which the sheet P having passed through the fixing device 20 is stacked.

Furthermore, the image forming apparatus 1 includes a sheet reversing mechanism 50 that turns the sheet P having passed through the fixing device 20 the other way round and feeds the sheet P to the transfer part Tp again. The sheet reversing mechanism 50 includes a reversal transport path SR branching off from the sheet transport path YR at a position on the downstream side of the fixing device 20 and merging with the sheet transport path YR at a position on the upstream side of the pair of registration rollers 47. The sheet reversing mechanism 50 further includes transport rollers 51 that transport the sheet P along the reversal transport path SR.

The image forming apparatus 1 includes a receiving unit 200 and a controller 300. The receiving unit 200 receives image data from a personal computer (PC) or the like (not illustrated). The controller 300 controls the operations of the image forming section 10, the fixing device 20, and the sheet feeding section 30.

Furthermore, the image forming apparatus 1 includes an image processing unit 400 and a user interface (UI) 500. The image processing unit 400 processes the image data having been received by the receiving unit 200 and subsequently outputs the image data to the exposure device 13. The UI 500 includes a display panel through which instructions made by the user are accepted and on which messages or the like are displayed to the user.

The controller 300 includes a central processing unit (CPU), a read-only memory (ROM), a random access memory (RAM), and a hard disk drive (HDD) (all not illustrated). The CPU executes processing programs. The ROM stores programs, tables, parameters, and the like. The RAM is used as a work area or the like when any of the programs is executed by the CPU.

An image is formed on a sheet P as follows. The receiving unit 200 receives image data created by a personal computer or the like (not illustrated) and outputs the image data to the image processing unit 400, where the image data is processed. The processed image data is output to the exposure device 13. The exposure device 13 having acquired the image data selectively performs exposure on the photoconductor drum 11 having been charged by the charging device 12, whereby an electrostatic latent image is formed on the photoconductor drum 11. The electrostatic latent image is developed into a toner image in, for example, black (K) by the development device 14.

Meanwhile, in the sheet feeding section 30, the pickup roller 43 rotates in accordance with the timing of image formation, whereby some sheets P are fed from the sheet container 41. One of the sheets P is separated from the others by the separating mechanism 45 and is transported to the pair of registration rollers 47, where the sheet P is stopped temporarily. Subsequently, the pair of registration rollers 47 rotate in accordance with the timing of rotation of the photoconductor drum 11 and transport the sheet P to the transfer part Tp, where the toner image on the photoconductor drum 11 is transferred to the sheet P.

Subsequently, the sheet P now having the toner image undergoes a fixing process performed by the fixing device 20 and is discharged onto the sheet stacking portion YS by a pair of discharge rollers 49. If an image is to be formed on a second side of the sheet P after an image has been formed on a first side of the sheet P (if images are to be formed on both sides of the sheet P), the sheet P having passed through the fixing device 20 is turned the other way round by the sheet reversing mechanism 50 and is fed to the transfer part Tp again. Then, another toner image having formed on the photoconductor drum 11 is transferred to the second side of the sheet P at the transfer part Tp. The sheet P now having the toner image on the second side thereof undergoes the fixing process performed by the fixing device 20 and is discharged onto the sheet stacking portion YS.

Here, the process cartridge 100 will be described in detail. The process cartridge 100 may be referred to as any of the following: process cartridge, drum cartridge, photoconductor cartridge, and development unit. The process cartridge 100 does not include the toner cartridge 60.

The process cartridge 100 includes the photoconductor drum 11, the charging device 12, the development device 14, and the cleaning device 16 (which are also collectively referred to as toner-image-forming section). The process cartridge 100 further includes the toner supplying unit 71 and the toner collecting unit 72.

Figure 2:
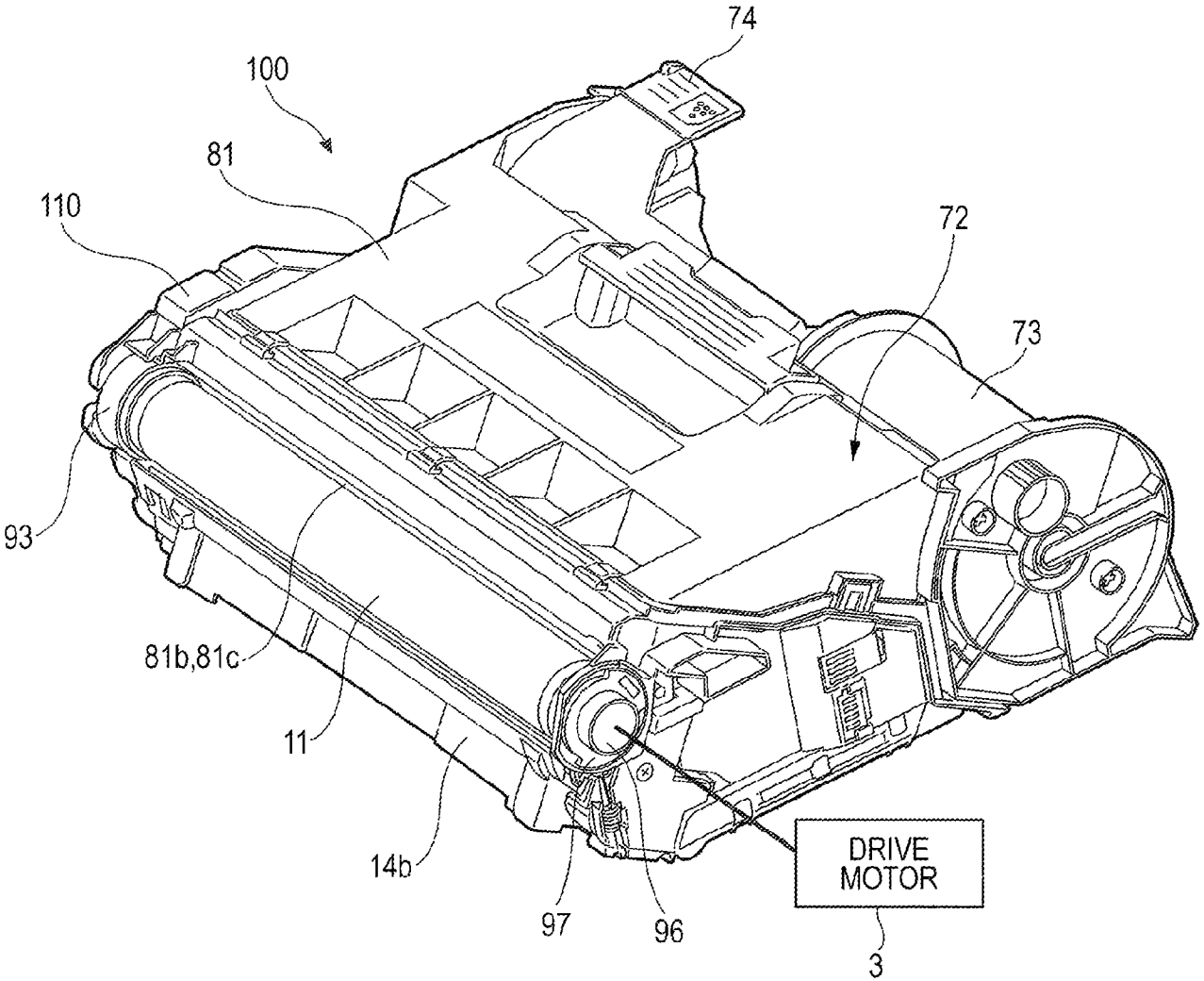
FIG. 2 is a perspective view of a process cartridge.

The process cartridge 100 further includes a container receiving portion 73 and a grip 74 (also illustrated in FIG. 2). The container receiving portion 73 receives the toner cartridge 60. The grip 74 is used in attaching or detaching the process cartridge 100 to or from the image forming apparatus 1.

The process cartridge 100 is a replaceable unit in which the photoconductor drum 11, the charging device 12, the development device 14, the cleaning device 16, the toner supplying unit 71, the toner collecting unit 72, the container receiving portion 73, and the grip 74 are provided as an integral body. Therefore, replacing the process cartridge 100 of the image forming apparatus 1 means that all of the photoconductor drum 11, the charging device 12, the development device 14, the cleaning device 16, the toner supplying unit 71, and the toner collecting unit 72 are replaced with new ones.

The toner cartridge 60 is detachably attached to the container receiving portion 73 of the process cartridge 100. Therefore, the toner cartridge 60 is detachable, or replaceable with a new one, from the container receiving portion 73 while the process cartridge 100 remains set in the image forming apparatus 1.

More specifically, the process cartridge 100 is attached to a receiving portion 2, which is an internal space provided in the body of the image forming apparatus 1. When a flap that forms a part of the outer surface (the front surface and the upper surface) of the image forming apparatus 1 is turned upward and is opened in a state where the process cartridge 100 is set in the receiving portion 2, the toner cartridge 60 and the container receiving portion 73 and the grip 74 of the process cartridge 100 are exposed.

The toner collecting unit 72 becomes unserviceable when filled up with waste toner. In such a case, the process cartridge 100 needs to be replaced with a new one. This means that the capacity of the toner collecting unit 72 is one of factors that determine the life of the process cartridge 100.

In view of the above, the process cartridge 100 is configured such that, as illustrated in FIG. 1, the toner collecting unit 72 is provided between the container receiving portion 73 and the toner-image-forming section so that the toner collecting unit 72 has as large a capacity as possible.

FIG. 2 is a perspective view of the process cartridge 100 seen from a side thereof having the photoconductor drum 11.

As illustrated in FIG. 2, in a state where the process cartridge 100 is set in the receiving portion 2 (see FIG. 1) of the image forming apparatus 1, the photoconductor drum 11 is exposed and is in contact with the transfer device 15. The photoconductor drum 11 rotates with a rotational driving force generated by a drive motor 3 provided on the body of the image forming apparatus 1.

The development housing 14*b* of the development device 14 resides below the photoconductor drum 11.

The container receiving portion 73 of the process cartridge 100 is capable of receiving any of toner cartridges 60 having different capacities. That is, the process cartridge 100 is attachable to an image forming apparatus 1 in which plural speed ranges are settable. Hence, the process cartridge 100 is capable of receiving a toner cartridge 60 having a large capacity when a high speed range is set, and is capable of receiving a toner cartridge 60 having a small capacity when a low speed range is set. The process cartridge 100 illustrated in FIG. 2 is ready for receiving a toner cartridge 60 having a small capacity.

Figure 3:
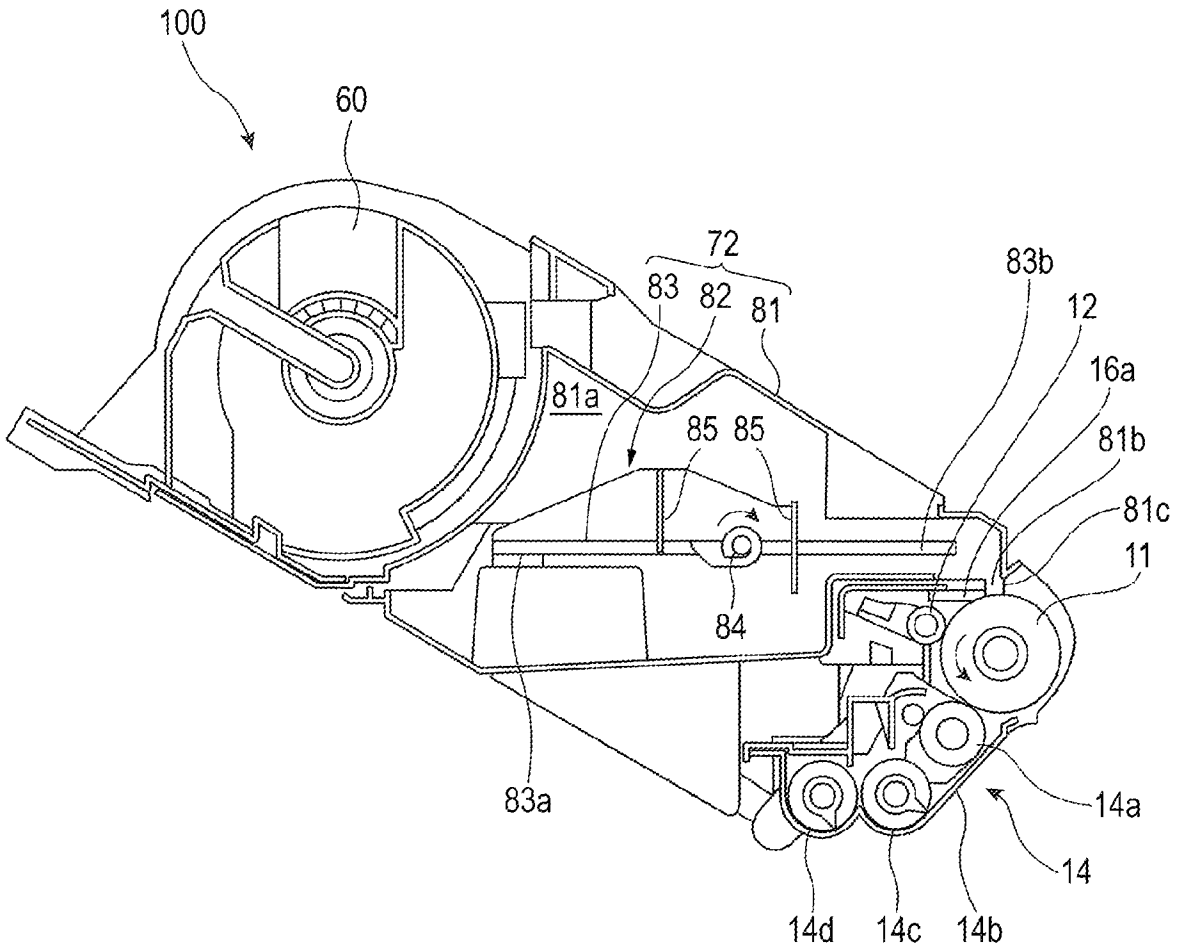
FIG. 3 illustrates a toner collecting unit.

FIG. 3 illustrates the toner collecting unit 72. As illustrated in FIG. 3, the toner collecting unit 72 of the process cartridge 100 includes a casing 81 (also illustrated in FIG. 2) and a collecting portion 82. The casing 81 has an internal space 81*a* in which waste toner is stored. The collecting portion 82 collects the waste toner in the internal space 81*a* of the casing 81.

The casing 81 has an intake 81*b* (also illustrated in FIG. 2) provided near the cleaning blade 16*a* of the cleaning device 16 and via which waste toner is taken into the internal space 81*a*. A toner blocking member 81*c* (also illustrated in FIG. 2) is provided on the upstream side of the cleaning blade 16*a* in the direction of rotation of the photoconductor drum 11 and prevents waste toner from leaking out of the process cartridge 100 via the intake 81*b*. The toner blocking member 81*c* is provided near the cleaning blade 16*a* and is in contact with the photoconductor drum 11.

The collecting portion 82 has a predetermined thickness and includes a frame structure 83 extending across the internal space 81*a* of the casing 81, a crank shaft 84 provided integrally with the frame structure 83, and upright walls 85 provided integrally with the frame structure 83 and standing upright in the internal space 81*a* of the casing 81.

The frame structure 83 of the collecting portion 82 has plural rectangular regions that are parted by frames. That is, the frame structure 83 forms a checkerboard-like grating, for example. The frame structure 83 contributes to sending of waste toner taken into the internal space 81*a* of the casing 81 via the intake 81*b* deep into the internal space 81*a* (toward the left side in FIG. 3), where the waste toner is stored.

The crank shaft 84 of the collecting portion 82 is provided between a downstream end 83*a* (the left end in FIG. 3) and an upstream end 83*b* (the right end in FIG. 3) of the frame structure 83. When the crank shaft 84 receives a rotational driving force, the crank shaft 84 rotates in one direction, specifically, a direction of the arrow illustrated in FIG. 3 (in the clockwise direction in FIG. 3).

More specifically, the downstream end 83*a* of the frame structure 83 is supported by the casing 81, whereas the upstream end 83*b* of the frame structure 83 is not supported by the casing 81, that is, the upstream end 83*b* is a free end. Hence, when the crank shaft 84 rotates in the direction of the arrow, the downstream end 83*a* of the frame structure 83 slides in the lateral direction in FIG. 3, whereas the upstream end 83*b* of the frame structure 83 moves along a circular path of a size larger than the displacement of the crank shaft 84. Thus, waste toner residing near the intake 81*b* is sequentially sent deep into the internal space 81*a*.

Figure 4:
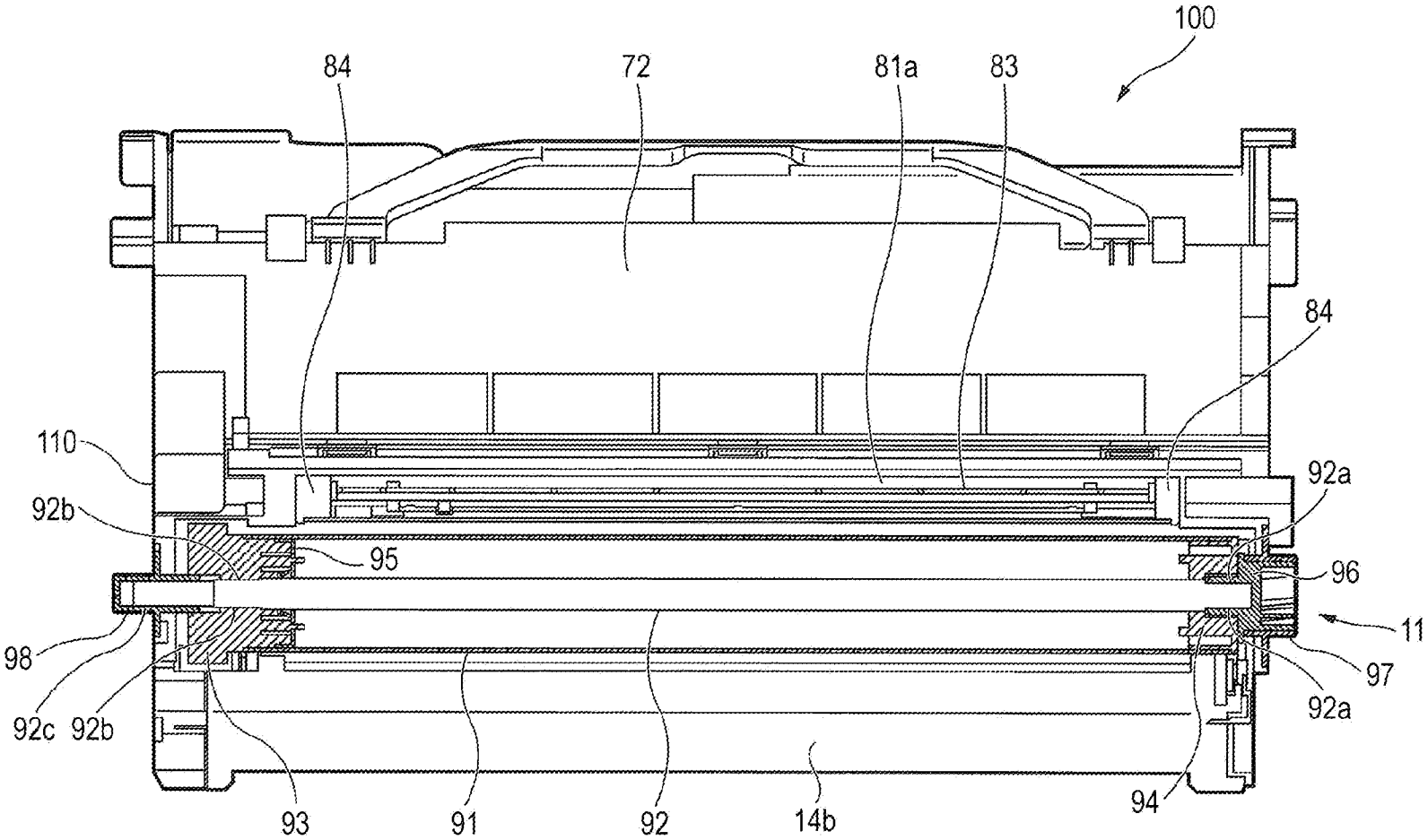
FIG. 4 illustrates a photoconductor drum.
Figure 5:
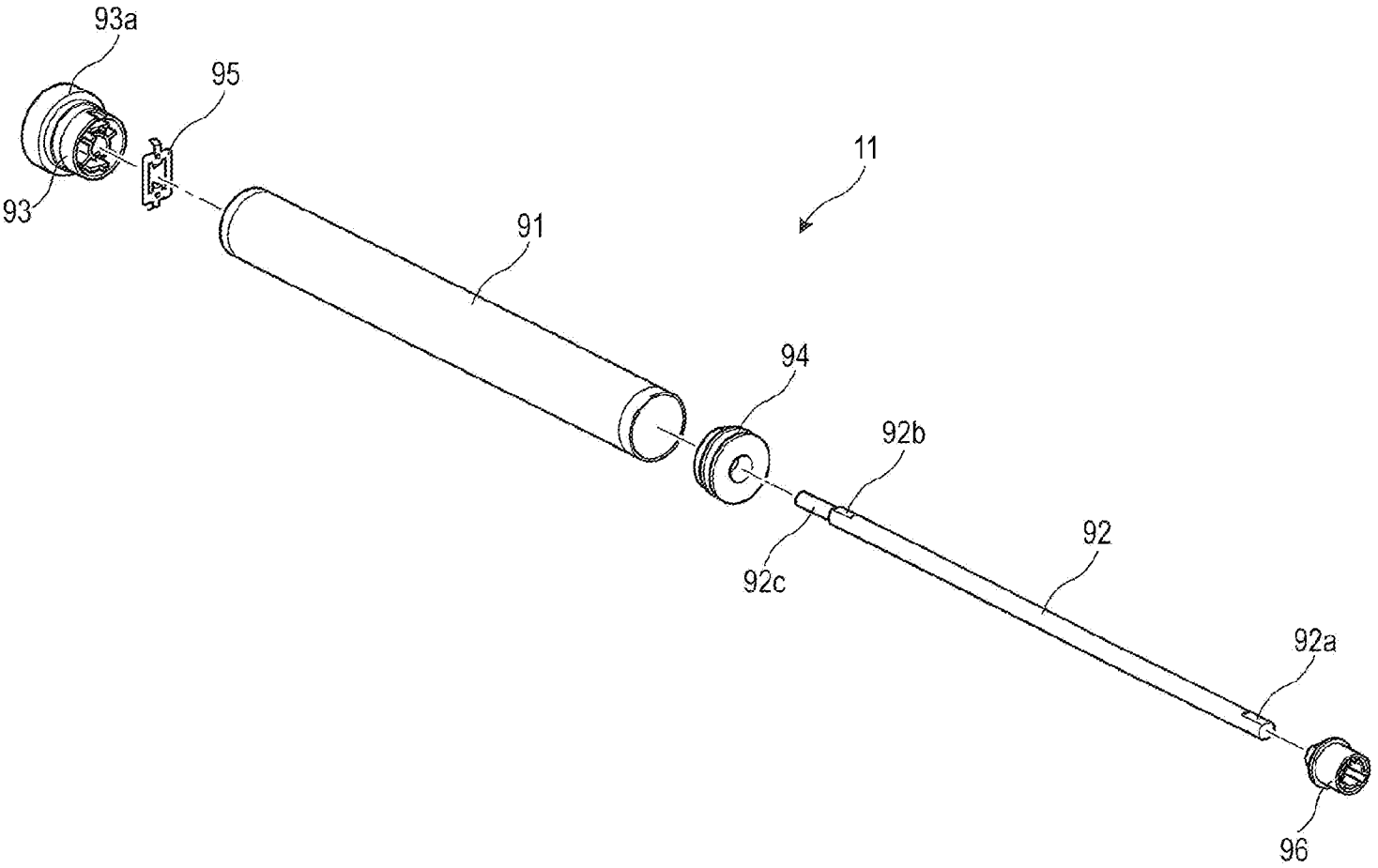
FIG. 5 illustrates the photoconductor drum.

FIGS. 4 and 5 illustrate the photoconductor drum 11. FIG. 4 is a vertical sectional view of the process cartridge 100 taken along a line passing through the photoconductor drum 11 and part of the casing 81. FIG. 5 is an exploded perspective view of the photoconductor drum 11. The photoconductor drum 11 illustrated in FIGS. 4 and 5 are seen from a side thereof nearer to the transfer device 15 (see FIG. 1).

As illustrated in FIGS. 4 and 5, the photoconductor drum 11 includes a cylindrical drum body 91 having a photosensitive layer provided on the outer circumferential surface thereof, and a driving-force-transmitting shaft 92 as a rod-type member extending through the drum body 91.

The photoconductor drum 11 further includes flanges 93 and 94 each interposed between the drum body 91 and the driving-force-transmitting shaft 92. The flanges 93 and 94 each engage with a corresponding one of two ends of the drum body 91 and a corresponding one of two ends of the driving-force-transmitting shaft 92, whereby the drum body 91 is centered with respect to the driving-force-transmitting shaft 92. The flanges 93 and 94 hold the drum body 91 at respective positions that are spaced apart from each other. The drum body 91 of the photoconductor drum 11 is grounded via a metal plate 95 provided in the drum body 91.

The flange 93 is provided on an output side (at the left end in FIGS. 4 and 5) of the driving-force-transmitting shaft 92 and has a gear (spur gear) 93*a* provided on the outer circumference thereof. The flange 94 is provided on an input side (at the right end in FIGS. 4 and 5) of the driving-force-transmitting shaft 92 and does not have any gear, unlike the flange 93.

Hereinafter, as a matter of convenience, the flange 93 is also referred to as geared flange 93, and the flange 94 is also referred to as gearless flange 94. The geared flange 93 may be made of, for example, polycarbonate that provides good slidability, whereas the gearless flange 94 may be made of, for example, acrylonitrile butadiene styrene (ABS).

More specifically, the photoconductor drum 11 includes a coupling 96 into which the rotational driving force generated by the drive motor 3 (see FIG. 2) provided on the body of the image forming apparatus 1 is input. The coupling 96 is provided on the input side (at the right end in FIGS. 4 and 5) of the driving-force-transmitting shaft 92.

Furthermore, a bearing 97 (see FIG. 4) is provided in contact with the coupling 96. The bearing 97 is not rotatable and is fixed to the process cartridge 100.

In addition, a bearing 98 (see FIG. 4) is provided on the output side (at the left end in FIGS. 4 and 5) of the driving-force-transmitting shaft 92. The bearing 98 is not rotatable and is fixed to the process cartridge 100.

A covering member 110 (illustrated in FIGS. 2 and 4) that covers a drive mechanism 120, to be described below, is provided on the output side (at the left end in FIGS. 4 and 5) of the driving-force-transmitting shaft 92.

The driving-force-transmitting shaft 92 of the photoconductor drum 11 will now be described in more detail. The driving-force-transmitting shaft 92 has at one end (on the input side) thereof two flat portions 92*a* each provided by cutting the round circumference of the driving-force-transmitting shaft 92. Outer circumferential surface portions extend between the two flat portions 92*a*. Therefore, the two flat portions 92*a* are not continuous with each other and are separate from each other.

The driving-force-transmitting shaft 92 has at the other end (on the output side) thereof two flat portions 92*b* each provided by cutting the round circumference of the driving-force-transmitting shaft 92, as with the flat portions 92*a* provided at the one end of the driving-force-transmitting shaft 92.

Furthermore, the driving-force-transmitting shaft 92 has at the other end thereof a reduced-diameter portion 92*c* having a reduced diameter and thus forming a step. The bearing 98 is fitted onto the reduced-diameter portion 92*c* of the driving-force-transmitting shaft 92.

The flat portions 92*a* of the driving-force-transmitting shaft 92 engage with the coupling 96. The flat portions 92*b* of the driving-force-transmitting shaft 92 engage with the geared flange 93. Thus, the rotational driving force that is input to the coupling 96 is transmitted to the geared flange 93 via the driving-force-transmitting shaft 92. The rotational driving force transmitted to the geared flange 93 is further transmitted to the drive mechanism 120, to be described below, via the gear 93*a* of the flange 93.

Since the gearless flange 94 engages with the coupling 96 (see FIG. 4), the rotational driving force that is input to the coupling 96 is transmitted to the drum body 91 via the gearless flange 94.

Thus, the rotational driving force that is input to the coupling 96 of the photoconductor drum 11 is transmitted to the geared flange 93 not via the drum body 91. Therefore, the drum body 91 is free from any load occurring with the rotational driving force transmitted to the geared flange 93 and does not tend to be twisted or deformed.

The coupling 96, which is gearless, is provided at the one end (on the input side) of the driving-force-transmitting shaft 92, whereas the geared flange 93 is provided at the other end (on the output side) of the driving-force-transmitting shaft 92. That is, the exemplary embodiment does not employ a configuration in which gears are provided on both the input side and the output side. Therefore, phasing of plural gears is not included in the assembly process, and the ease of assembly is increased.

The flat portions 92*a* and 92*b* of the driving-force-transmitting shaft 92 function as stoppers that stop the rotation or sliding of the coupling 96 and the geared flange 93. That is, since the flat portions 92*a* and 92*b* of the driving-force-transmitting shaft 92 engage with the coupling 96 and the flange 93, respectively, the coupling 96, the driving-force-transmitting shaft 92, and the geared flange 93 are fixedly connected to one another, preventing the occurrence of any losses of the rotational driving force that is input to the coupling 96 due to slipping or the like that may occur among the foregoing members that are connected to one another. Moreover, as described above, the drum body 91 is free from any unwanted load that may occur with the rotational driving force that is input to the coupling 96. Consequently, the occurrence of troubles in forming images is suppressed.

Now, a process of assembling the photoconductor drum 11 will be described with reference to FIG. 5.

The driving-force-transmitting shaft 92 is inserted into the drum body 91. Then, the reduced-diameter portion 92*c* and the flat portions 92*b* of the driving-force-transmitting shaft 92 are inserted into and are made to engage with the geared flange 93. Thus, the driving-force-transmitting shaft 92 and the geared flange 93 are positioned with respect to each other.

Subsequently, the driving-force-transmitting shaft 92 is inserted into the gearless flange 94. Then, the coupling 96 is fitted onto and is made to engage with the flat portions 92*a* of the driving-force-transmitting shaft 92. Thus, the coupling 96 and the driving-force-transmitting shaft 92 are positioned with respect to each other, and the gearless flange 94 and the coupling 96 are positioned with respect to each other.

Subsequently, the one end of the drum body 91 is made to engage with the gearless flange 94 and is fixed thereto with adhesive, and the geared flange 93 is lightly press-fitted into the other end of the drum body 91. Thus, the assembly of the photoconductor drum 11 is complete. In the exemplary embodiment, since the geared flange 93 is lightly press-fitted into the drum body 91, the drum body 91 and the geared flange 93 rotate together, not independently of each other. Such a situation may also be expressed as follows: the rotational driving force that is input to the coupling 96 of the photoconductor drum 11 is transmitted to the geared flange 93 via the drum body 91. Nevertheless, the load to be applied to the drum body 91 is reduced by the presence of the driving-force-transmitting shaft 92, compared with a configuration in which a rotational driving force is transmitted from one end to the other end of a photoconductor drum with no aid other than a drum body. In other words, in the photoconductor drum 11, the drum body 91 does not tend to be twisted or deformed because the driving-force-transmitting shaft 92 is driven to rotate at both the one end (the right end in FIG. 5) thereof and the other end (the left end in FIG. 5) thereof. The drum body 91 and the geared flange 93 may be fixed to each other with adhesive or the like, according to need.

In the exemplary embodiment, two components, specifically, the coupling 96 and the gearless flange 94, are provided on the input side of the driving-force-transmitting shaft 92. In assembling the photoconductor drum 11 having such a configuration, the gearless flange 94 does not need to be positioned with respect to the driving-force-transmitting shaft 92.

In the exemplary embodiment, the driving-force-transmitting shaft 92 is a rod-type member having a round cross-sectional shape and has the flat portions 92*a* and 92*b*. The driving-force-transmitting shaft 92 is not limited to such a member. For example, instead of the flat portions 92*a* and 92*b* that function as stoppers that stop the rotation of the driving-force-transmitting shaft 92 having a round cross-sectional shape, portions each having another shape, such as key grooves, may be provided in the driving-force-transmitting shaft 92. For another example, a rod-type member having a polygonal or rectangular cross-sectional shape may be employed as the driving-force-transmitting shaft 92.

Figure 6:
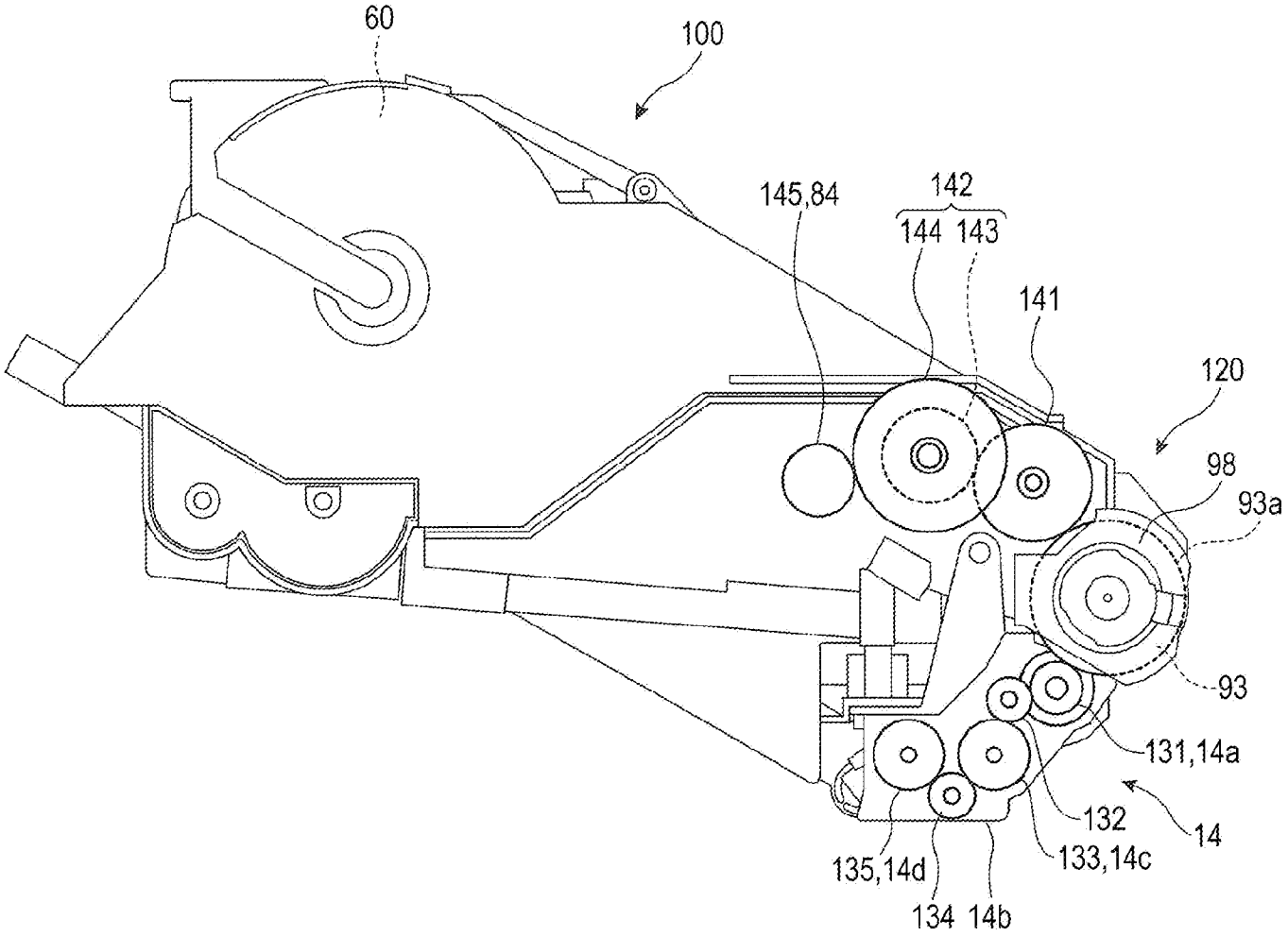
FIG. 6 illustrates a drive mechanism that generates a rotational driving force to be transmitted from a driving-force-transmitting shaft of the photoconductor drum.

FIG. 6 illustrates the drive mechanism 120 that generates a rotational driving force to be transmitted from the driving-force-transmitting shaft 92 of the photoconductor drum 11. In FIG. 6, the covering member 110 (see FIGS. 2 and 4) that covers the drive mechanism 120 is not illustrated.

The drive mechanism 120 illustrated in FIG. 6 includes a first driving-force-transmitting path via which the driving force generated by the drive motor 3 (see FIG. 2) is transmitted from the gear 93*a* of the geared flange 93 to the development device 14, and a second driving-force-transmitting path via which the driving force generated by the drive motor 3 (see FIG. 2) is transmitted from the gear 93*a* of the geared flange 93 to the crank shaft 84 of the toner collecting unit 72 (see FIG. 1).

Therefore, neither a drive source that supplies a rotational driving force to the development device 14 nor a drive source that supplies a rotational driving force to the toner collecting unit 72 are necessary in addition to the drive motor 3 (see FIG. 2). Hence, in the exemplary embodiment, the number of drive sources is reduced, and the drive mechanism 120 has a simple configuration. Moreover, the internal space of the apparatus body is efficiently used. Consequently, the size of the apparatus body is reduced.

More specifically, the first driving-force-transmitting path includes a gear 131 provided at an end of the development roller 14*a* of the development device 14 and meshing with the gear 93*a* of the geared flange 93, a gear 133 provided at an end of the auger 14*c* of the development device 14, and a gear 135 provided at an end of the auger 14*d* of the development device 14. The first driving-force-transmitting path further includes an idler 132 meshing with both the gear 131 and the gear 133, and an idler 134 meshing with both the gear 133 and the gear 135. The gears 131 and others are arranged in series.

Thus, in the first driving-force-transmitting path, the rotational driving force is transmitted from the gear 93*a* of the geared flange 93 to the gear 131, the idler 132, the gear 133, the idler 134, and the gear 135 in that order.

The second driving-force-transmitting path includes a gear 141 meshing with the gear 93*a* of the geared flange 93, and a gear 145 provided at an end of the crank shaft 84. The second driving-force-transmitting path further includes a double gear 142. The double gear 142 includes a gear 143 meshing with the gear 141 and a gear 144 meshing with the gear 145. The gear 143 and the gear 144 are provided coaxially.

More specifically, in the double gear 142, the gear 144 meshing with the gear 145 has a larger diameter than the gear 143 meshing with the gear 141. Therefore, the double gear 142 reduces the rotational speed of the rotational driving force that is input thereto from the gear 141, and then outputs the rotational driving force to the gear 145. Consequently, a torque that is proportional to the speed reduction ratio is obtained as an output to the gear 145.

Thus, the double gear 142 functions as a deceleration unit. The pitch circles of the gears 141 and 143 to 145 may be set arbitrarily according to design conditions.

The deceleration function of the double gear 142 contributes to the suppression of the occurrence of banding on the photoconductor drum 11. The rotational driving force required in the second driving-force-transmitting path is larger than that required in the first driving-force-transmitting path. In other words, the rotation of the crank shaft 84 of the toner collecting unit 72 (see FIG. 1) may adversely influence the rotation of the photoconductor drum 11 and may trigger the occurrence of banding.

In the exemplary embodiment, the deceleration function of the double gear 142 contributes to a reduction of the adverse influence on the rotation of the photoconductor drum 11, thereby suppressing the occurrence of banding.

Increasing the accuracy of the gears 131 and others included in the first driving-force-transmitting path also contributes to the suppression of the occurrence of banding described above.

The drive motor 3 provided on the apparatus body is an exemplary drive source. The photoconductor drum 11 is an exemplary image forming object. The driving-force-transmitting shaft 92 is an exemplary rotatable shaft. The development device 14 is an exemplary development unit. The transfer device 15 is an exemplary transfer unit. The geared flange 93 is an exemplary extracting member.

The development roller 14*a*, the auger 14*c*, and the auger 14*d* of the development device 14 are exemplary rotary members. The frame structure 83 and the crank shaft 84 of the collecting portion 82 are exemplary collecting members. The double gear 142 is an exemplary deceleration unit. The coupling 96 is an exemplary transmitting member excluding a gear.

The drive mechanism 120 may alternatively be provided on the input side of the driving-force-transmitting shaft 92. However, the drive motor 3 (see FIG. 2) is provided at a position of the apparatus body on the input side of the driving-force-transmitting shaft 92. Moreover, a high-voltage circuit board (not illustrated) and other relevant components are provided at a position of the apparatus body on the output side of the driving-force-transmitting shaft 92. Therefore, if the drive mechanism 120 is provided on the input side of the driving-force-transmitting shaft 92 on which the drive motor 3 (see FIG. 2) and other relevant components are provided, the drive motor 3 (see FIG. 2) and other relevant components need to be shifted by an amount corresponding to the thickness of the gears 131 and others included in the drive mechanism 120. Correspondingly, the width (the dimension in the depth direction in FIG. 1) of the apparatus body increases by the amount by which the drive motor 3 (see FIG. 2) and other components are shifted.

Instead of the configuration (according to the exemplary embodiment) in which the drive mechanism 120 is provided on the output side of the driving-force-transmitting shaft 92 and the transmission of the rotational driving force is realized with the driving-force-transmitting shaft 92, another configuration may be acceptable in which the driving-force-transmitting shaft 92 is omitted and the drive mechanism 120 is provided on a side of the photoconductor drum 11 on which the drive motor 3 is provided (on the right side in FIGS. 4 and 5). In the latter case, however, the apparatus body becomes large as a matter of layout in the apparatus body.

That is, if the configuration according to the exemplary embodiment is employed in which the drive mechanism 120 is provided on a side of the photoconductor drum 11 opposite the side on which the drive motor 3 is provided (on the left side in FIGS. 4 and 5), the increase in the size of the apparatus body is suppressed.

Thus, the drive mechanism 120 according to the exemplary embodiment that supplies a rotational driving force to the development device 14 and the toner collecting unit 72 that are provided adjacent to the photoconductor drum 11 has a simple configuration.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a drive source that generates a driving force;

an image forming object on which an electrostatic latent image is to be formed and that includes a cylindrical member and a rotatable shaft passing through the cylindrical member, the rotatable shaft comprising at least one flat portion at one end of a surface along a longitudinal axis of the rotatable shaft;

a first member provided at the one end of the rotatable shaft to which the driving force is input;

a second member configured to hold the image forming object, wherein the first member is configured to be disposed between the second member and the rotation shaft and the first member is configured to engage with the second member and the driving force input to the first member is transmitted to the image forming object via the second member; and an extracting member that is provided at another end of the rotatable shaft of the image forming object and extracts, from the rotatable shaft, the driving force to be transmitted to a driven member.

2. The image forming apparatus according to claim 1, further comprising:

a development unit that includes a rotary member and develops the electrostatic latent image on the image forming object with developer; and a collecting member that collects residues of the developer having been removed from the image forming object, wherein the extracting member extracts the driving force to be transmitted to at least one of the rotary member of the development unit and the collecting member.

3. The image forming apparatus according to claim 1, further comprising:

a deceleration unit that reduces a rotational speed of the driving force extracted by the extracting member and outputs the driving force with the reduced rotational speed.

4. The image forming apparatus according to claim 1, wherein one of the first member and the extracting member transmits the driving force with a gear, and the other transmits the driving force without a gear.

5. The image forming apparatus of claim 1, wherein the rotatable shaft is configured to be inserted into the cylindrical member.

6. The image forming apparatus of claim 1, wherein the image forming object rotates with the driving force that is input to the one end of the surface along the longitudinal axis of the rotatable shaft.

7. The image forming apparatus of claim 1, wherein the rotatable shaft comprises a circumferential surface and the at least one flat portion is a flat cutout in the circumferential surface.

8. The image forming apparatus of claim 7, wherein the rotatable shaft comprises at least two of the flat portions at one end of the surface along the longitudinal axis of the rotatable shaft, and the at least two flat portions are flat cutouts in the circumferential surface, and wherein the circumferential surface of the rotatable shaft extends between the at least two flat portions.

9. The image forming apparatus of claim 1, wherein the first member is configured to be disposed between the second member and the rotation shaft on the at least one flat portion at the one end of the rotatable shaft.

10. The image forming apparatus of claim 9, wherein the first member is provided directly on the one end of the rotatable shaft to which the driving force is input.

11. A process cartridge to be detachably attached to a body of an image forming apparatus, the process cartridge comprising:

an image forming object on which an electrostatic latent image is to be formed and that includes a cylindrical member and a rotatable shaft passing through the cylindrical member, the rotatable shaft comprising at least one flat portion at one end of a surface along a longitudinal axis of the rotatable shaft;

a first member provided on the one end of the rotatable shaft to which a driving force is input;

a second member configured to hold the image forming object, wherein the first member is configured to be disposed between the second member and the rotation shaft and the first member is configured to engage with the second member and the driving force input to the first member is transmitted to the image forming object via the second member; and an extracting member that is provided at another end of the rotatable shaft of the image forming object and extracts, from the rotatable shaft, the driving force to be transmitted to a driven member.

12. The process cartridge of claim 11, wherein the rotatable shaft is configured to be inserted into the cylindrical member.

13. The process cartridge of claim 11, wherein the rotatable shaft comprises a circumferential surface and the at least one flat portion is a flat cutout in the circumferential surface.

14. The process cartridge of claim 13, wherein the rotatable shaft comprises at least two of the flat portions at one end of the surface along the longitudinal axis of the rotatable shaft, and the at least two flat portions are flat cutouts in the circumferential surface, and wherein the circumferential surface of the rotatable shaft extends between the at least two flat portions.

15. The process cartridge of claim 11, wherein the first member is configured to be disposed between the second member and the rotation shaft on the at least one flat portion at the one end of the rotatable shaft.

16. The process cartridge of claim 15, wherein the first member is provided directly on the one end of the rotatable shaft to which the driving force is input.

17. An image forming method comprising:

generating a driving force;

transmitting the driving force to one end of a rotatable shaft;

rotating, with the driving force, an image forming object on which an electrostatic latent image is to be formed and that includes a cylindrical member and the rotatable shaft passing through the cylindrical member, the rotatable shaft comprising at least one flat portion at one end of a surface along a longitudinal axis of the rotatable shaft, wherein a first member is provided on the one end of the rotatable shaft to which the driving force is input, and a second member is configured to hold the image forming object, wherein the first member is configured to be disposed between the second member and the rotation shaft and the first member is configured to engage with the second member and the driving force input to the first member is transmitted to the image forming object via the second member; and extracting, from another end of the rotatable shaft of the image forming object, the driving force to be transmitted to a driven member.

18. The method of claim 17, wherein the rotatable shaft is inserted into the cylindrical member.

19. The method of claim 17, wherein the rotatable shaft comprises a circumferential surface and the at least one flat portion is provided by cutting the circumferential surface.

20. The method of claim 19, wherein the rotatable shaft comprises at least two of the flat portions at one end of the surface along the longitudinal axis of the rotatable shaft, and the at least two flat portions are provided by cutting the circumferential surface, and wherein the circumferential surface of the rotatable shaft extends between the at least two flat portions.

21. The method of claim 17, wherein the first member is configured to be disposed between the second member and the rotation shaft on the at least one flat portion at the one end of the rotatable shaft.

22. The method of claim 21, wherein the first member is provided directly on the one end of the rotatable shaft to which the driving force is input.

* * * * *